US007204585B2

(12) United States Patent
Bruinsma et al.

(10) Patent No.: US 7,204,585 B2
(45) Date of Patent: Apr. 17, 2007

(54) METHOD AND SYSTEM FOR IMPROVING PRINTER PERFORMANCE

(75) Inventors: Paul J. Bruinsma, San Diego, CA (US); Matthew D. Giere, San Diego, CA (US); James A. Mott, San Diego, CA (US); Michael Harp, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 416 days.

(21) Appl. No.: 10/833,402

(22) Filed: Apr. 28, 2004

(65) Prior Publication Data

US 2005/0243139 A1 Nov. 3, 2005

(51) Int. Cl.
*B41J 2/05* (2006.01)

(52) U.S. Cl. ..... 347/60; 347/57

(58) Field of Classification Search ..... 347/14, 347/19, 56–61, 67

See application file for complete search history.

(56) References Cited

U.S. PATENT DOCUMENTS

| | | | | |
|---|---|---|---|---|
| 5,172,134 | A * | 12/1992 | Kishida et al. | 347/60 |
| 5,838,339 | A | 11/1998 | Silverbrook | 347/9 |
| 6,019,457 | A | 2/2000 | Silverbrook | 347/65 |
| 6,418,823 | B1 | 7/2002 | Taitler | 83/36 |
| 6,478,410 | B1 | 11/2002 | Prasad et al. | 347/65 |
| 6,641,247 | B2 | 11/2003 | Ide et al. | 347/23 |

* cited by examiner

*Primary Examiner*—Juanita D. Stephens

(57) ABSTRACT

A system and a method for improving printing performance are provided. One method of improving printing performance performing a first print operation utilizing a printhead comprising a plurality of resistors by ejecting ink from a plurality of chambers each associated with at least one of at least some of the plurality of resistors, selectively energizing at least some of the plurality of resistors at an energy level insufficient to eject ink from the plurality of chambers, and performing a second print operation utilizing the printhead.

16 Claims, 9 Drawing Sheets

METHOD AND SYSTEM FOR IMPROVING PRINTER PERFORMANCE

BACKGROUND

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper. Typically, the orifices are arranged in one or more arrays such that properly sequenced ejection of ink from the orifices causes characters or other images to be printed upon the print medium.

Between drop ejections, ink in the orifices suffers from evaporation. With the evaporation, material especially dye can precipitate out of the ink, which can result in the formation of a viscous plug in the orifice. Raising the ink viscosity can slow evaporation by reducing the diffusion rate of water from the bulk ink. If too much dye, or other material, precipitates out or the viscous plug that forms is too big, poor first-drop out ink drop volumes or weights may happen when ink is ejected from the orifice. If a printhead is left at an excessively high temperature for a period of time when it does not eject ink, the time may be short before the ink thickens and becomes a defect-producing nozzle obstruction.

One method to reduce this thickening of ink or prevent formation of a viscous plug is to eject ink, which may or may not be thickened, out of the nozzles a multitude of times at regularly scheduled intervals, where the ejected ink is not part of printing images onto a media. This process is also referred to as spitting. Generally, spitting occurs either into a spittoon ink collection device or on the margins of the paper. When ink is spit onto the margins, the margins need to be trimmed away from the printed image in a post-printing operation that adds cost and time to printing. Often for ink formulations with poor ink thickening properties no drops may be ejected on the first ten, hundred or even thousand energizing of a resistor, but the nozzles do eventually recover.

Another method to improve ink ejection performance is to alter ink formulations in order to change the characteristics of the ink. However, this can constrain the overall ink formulation and is not always feasible with competing interest, e.g. image gloss, fast drying or adhesion to the media, in ink formulation.

Since, some warming of the printhead, eg. at 35 to 50° C., is normally needed to maintain consistent drop weight during printing, another approach to improve ink ejection performance consists of warming the printhead die to high temperatures, e.g. above 50° C., and maintaining the printhead die at a substantially constant temperature whether ink is being ejected or not. While such an approach can be effective, excessive temperature elevation of the printhead can reduce printhead life by accelerating diffusion of ink into adhesive joints. Further, excessive warming of the printhead adds to the cost to the printer operation.

Therefore, there exists a need to improve ink ejection performance without the disadvantages associated with known approaches.

It is understood that the above-described embodiments are merely illustrative of the possible specific embodiments which may represent principles of the present invention. Other arrangements may readily be devised in accordance with these principles by those skilled in the art without departing from the scope and spirit of the invention.

DETAILED DESCRIPTION

In the following detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting.

Figure 1:
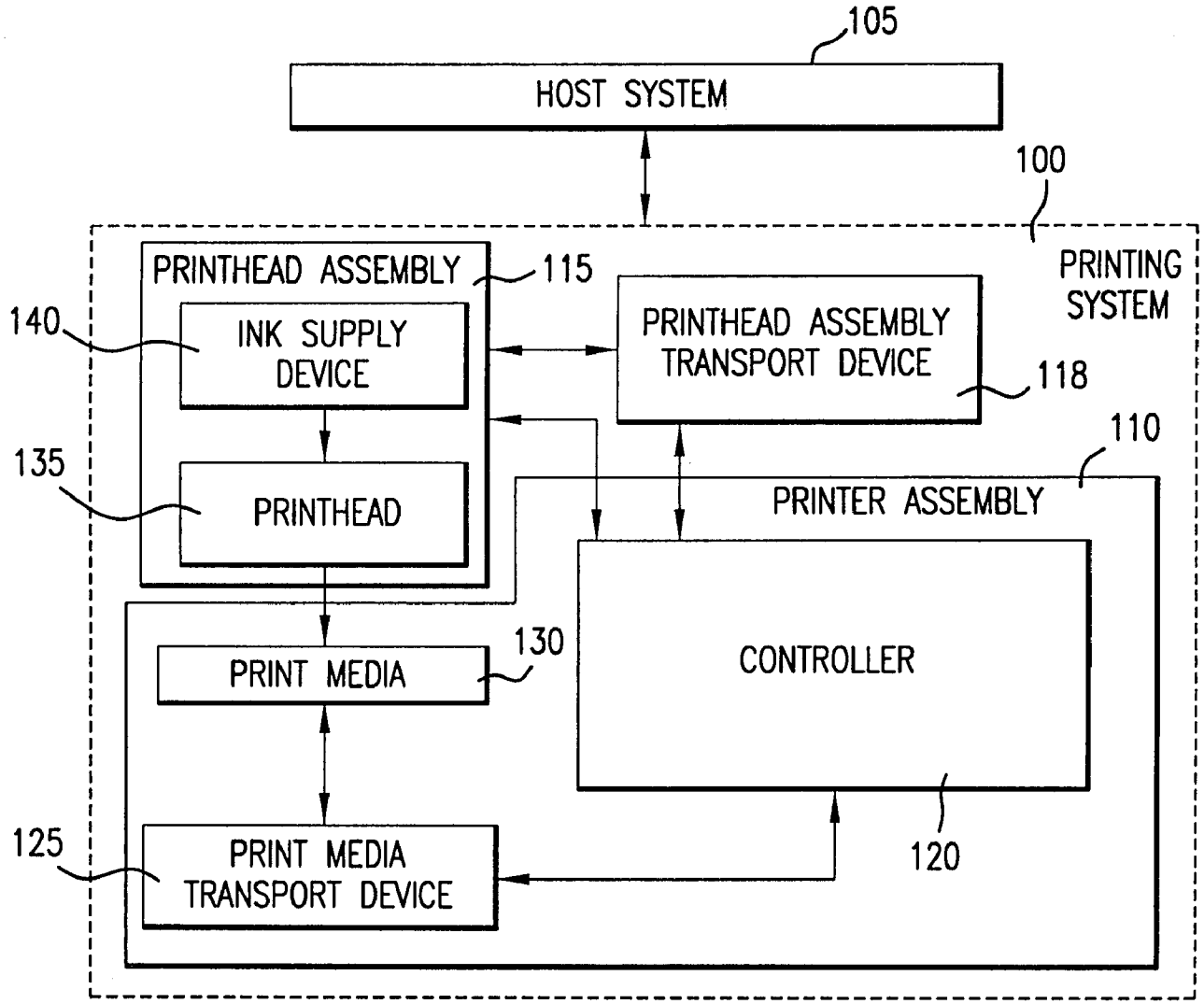
FIG. 1 illustrates a block diagram of elements of a printing system according to one embodiment.

Referring to FIG. 1, a block diagram of elements of a printing system 100 according to one embodiment is illustrated. The printing system 100 can be used for printing on any suitable material, such as paper media, transfer media, transparency media, photographic paper and the like. In general, the printing system communicates with a host system 105, which can be a computer or microprocessor that produces print data. The printing system 100 includes a printer assembly 110, which controls the printing system, a printhead assembly 115 that ejects ink and a printhead assembly transport device 118 that positions the printhead assembly 115 as required.

The printer assembly 110 includes a controller 120, a print media transport device 125 and a print media 130. The print media transport device 125 positions the print media 130 (such as paper) according the control instructions received from the controller 120. The controller 120 provides control instructions to the print media transport device 125, the printhead assembly 115 and the printhead assembly transport device 118 according to instructions received from various microprocessors within the printing system 100. In addition, the controller 120 receives the print data from the host system 105 and processes the print data into printer control information and image data. This printer control information and image data is used by the controller 120 to control the print media transport device 125, the printhead assembly 115 and the printhead assembly transport device 118. For example, the printhead assembly transport device 118 positions the printhead 135 over the print media 130 and the printhead 135 is instructed to eject ink drops according to the printer control information and image data.

The printhead assembly 115 is preferably supported by a printhead assembly transport device 118 that can position the printhead assembly 115 over the print media 130. Preferably, the printhead assembly 115 is capable of overlying any area of the print media 130 using the combination of the printhead assembly transport device 118 and the print media transport device 125. For example, the print media 130 may be a rectangular sheet of paper and the printhead assembly transport device 125 may position the paper in a media transport direction while the printhead assembly transport device 118 may position the printhead assembly 115 across the paper in a direction transverse to the media transport direction.

The printhead assembly 115 includes an ink supply device 140 that is fluidically coupled to the printhead 135 for selectively providing ink to the printhead 135. The printhead 135 includes a plurality of ink drop delivery systems, such as an array of ink jet nozzles or ink ejection elements. As discussed further below, each ink drop delivery system forms a printed material by ejecting a drop of ink onto the print media 130 according to instructions from the controller 120.

In one embodiment, controller 120 provides energy pulses that are of a certain magnitude and period that are sufficient to cause ink to be ejected from orifices of printhead 135. In other embodiments, printhead assembly may be coupled to a power supply and generate the energy pulses internally.

Figure 2A:
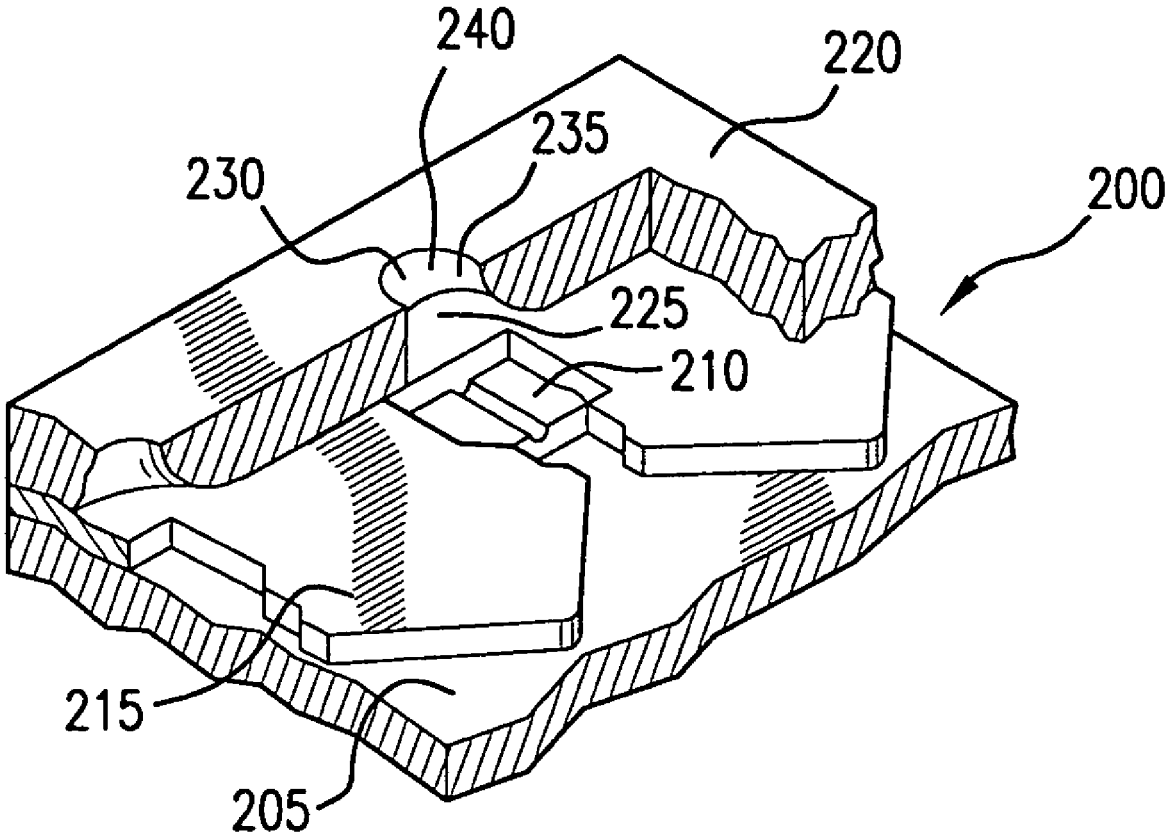
FIG. 2A illustrates a cut-away perspective view of an ink ejection element of a printhead according to one embodiment.

Referring to FIG. 2A, a cut-away perspective view of an ink ejection element 200 of a printhead assembly 115 according to one embodiment is illustrated. The ink ejection element 200 is disposed on a substrate 205 and includes a thin-film resistor 210. Overlying the resistor 210 is a barrier layer 215 and an orifice layer 220, both discussed further below. The top of the thin-film resistor 210 and the barrier and orifice layers 215, 220 form a chamber 225 where ink is vaporized by the resistor 210 and ejected through an orifice 230 (such as a nozzle). Each component and layer of the ink ejection element 200 may be formed separately or integrally and various methods for forming these components and layers are known in the art. For example, the barrier and orifice layers can be applied separately or formed integrally and then applied to the underlying substrate layer.

In operation, ink is kept from droning out of the nozzles by the application of a few inches of hydrostatic backpressure. When the resistor located just above the nozzle (the nozzles on the printhead point down) is powered with a pulse of electrical energy a vapor bubble is briefly created before the heat is dissipated and the bubble collapses. In typical operation, the force of the vapor bubble expansion ejects a drop of ink down onto the paper (or media). Upon bubble collapse the ink volume is replaced by ink flowing through the channels from the bulk ink.

Chamber 225 includes a lower portion 235 and an upper portion 240. Upper portion 240 interfaces with the air from the external environment. This interface allows for evaporation of a carrier fluid, e.g. water, into the air. The evaporation of the carrier fluid can result in a thickening of ink in upper portion 240. The thickening occurs because the dye that provides the colorant for the ink generally has a greater viscosity with increasing concentration. In addition, other ink components including, but not limited to, organic solvents, surfactants, pH buffers, and polymeric additives also increase the ink viscosity with water, which is often the carrier fluid, loss. The ink may be comprised of a pigment or a mixture of dye and pigment as colorants. These materials would also tend to increase the ink viscosity with water loss. If too much material precipitates out or the viscous plug is too big, poor first-drop-out ink ejection occurs.

Another reason for the evaporation of the carrier fluid from ink in the upper portion 240 of chamber 225 is the fact that there is a temperature difference between in the ink in the lower portion 235 and upper portion 240. The temperature difference is a result of the ink that is in orifice 230 not being circulated throughout chamber 225.

Figure 2B:
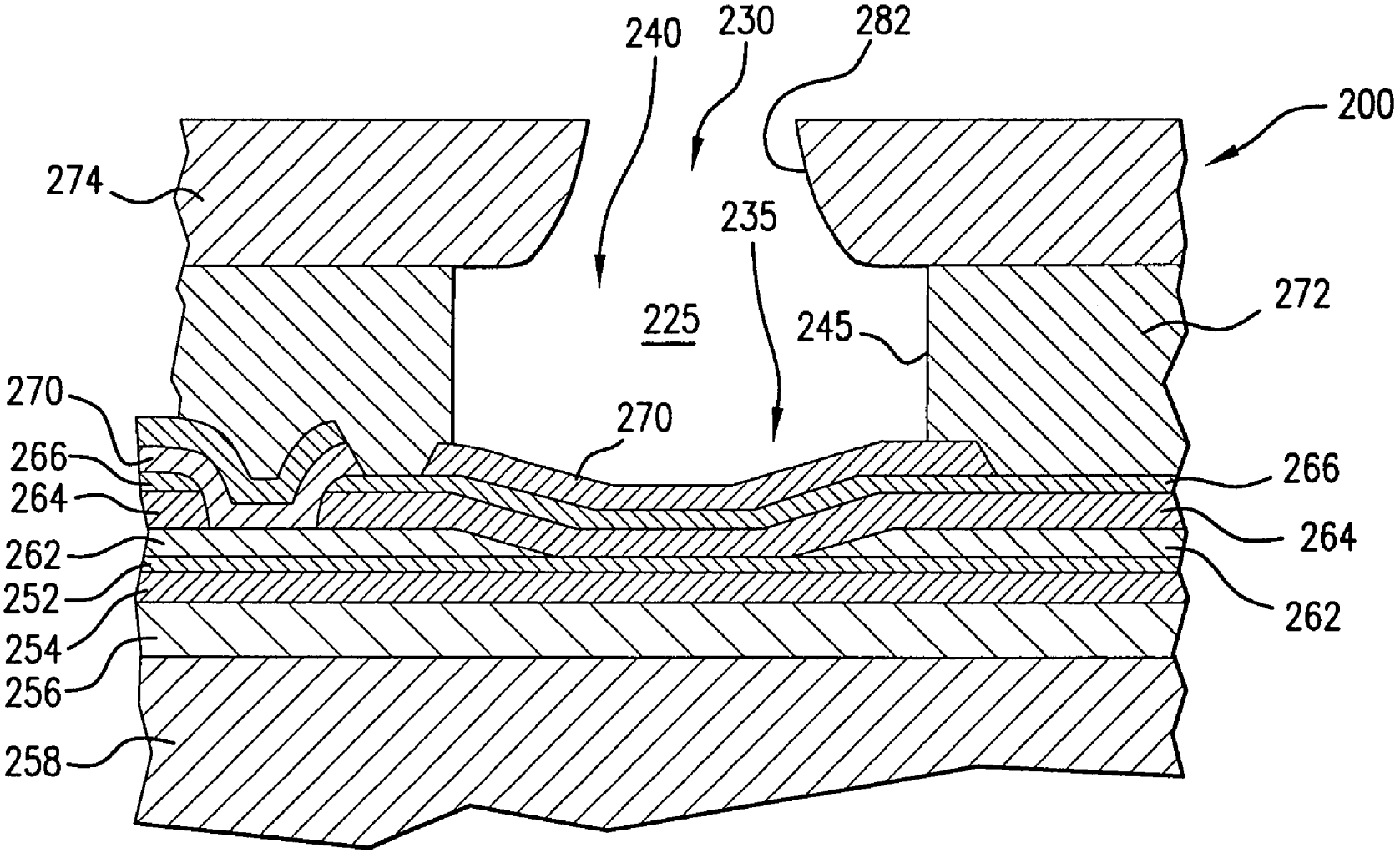
FIG. 2B illustrates a side view of an ink ejection element of a printhead according to one embodiment.

Referring to FIG. 2B, a side view of an ink ejection element 200 of a printhead assembly 115 according to one embodiment is illustrated. FIG. 2B is a cross-section along AA' from shown in FIG. 2A. In one embodiment, the resistor layer 252 is made of tantalum aluminum alloy and overlies a layer of polysilicon glass (PSG) 254 and Field Oxide 256 disposed on a silicon substrate 258. Preferably, the resistor layer 252 is approximately 900 angstroms thick. Overlying a portion of the resistor layer 252 is a conductor layer 262 comprised of an aluminum silicon copper alloy.

The resistor layer 252 is protected from damage by a first passivation layer 227 comprised of silicon nitride and a second passivation layer 266 comprised of silicon carbide. In this working example the thickness of the first passivation layer 264 is 2570 angstroms and the thickness of the second passivation layer 266 is 1280 angstroms. The combination of the first passivation layer 264 and the second passivation layer 266 comprise a total passivation layer. In a preferred embodiment, the total passivation layer is kept to a thickness of less than about 5000 angstroms with a preferred range between about 3500 to 4500 angstroms. At this passivation layer thickness the energy required to energize the resistor layer 252 is less than 1.4 microjoules.

Overlying the second passivation layer 266 is a cavitation layer 270 that protects the resistor layer 252 and passivation layers 264, 266 from damage due to ink drop cavitation and collapse. Preferably, the cavitation layer 270 is comprised of tantalum (Ta) having a thickness of 3000 angstroms. A barrier layer 272 (approximately 14 microns thick) and an orifice layer 274 (approximately 25 microns thick) overlie the cavitation layer 270. The cavitation layer 270, barrier layer 272 and orifice layer 274 create a chamber 225 where ink is vaporized by the resistor layer 252 and ejected from a nozzle 230 created by the orifice layer 274.

FIG. 2B, shows a side view of lower portion 235 and upper portion 240 of chamber 225. In FIG. 2B, it can be seen that the upper portion 240 is at the air interface of nozzle 230 from which ink is ejected. In addition, orifice layer 274 may have precipitate dye that forms a viscous plug like structure adhered to its walls 282 or increases the viscosity of the ink in the upper portion 240.

In order to recover from the formation of viscous plugs and reduce the viscosity of the ink in the upper portion 240 of chamber 225, the ink is heated repeatedly during time periods when the printhead assembly is not printing. Non-limiting examples of such time periods include between different print swaths, at power up of printer assembly 110, or a fixed amount of time after the completion of a print operation. This heating, which is performed at a lower peak temperature than that which is needed for nucleation, reduces the viscosity increase of the ink in upper portion 240, that had occurred due to evaporation, and the breaks-up plugs that are formed in the nozzle 230.

Figure 3:
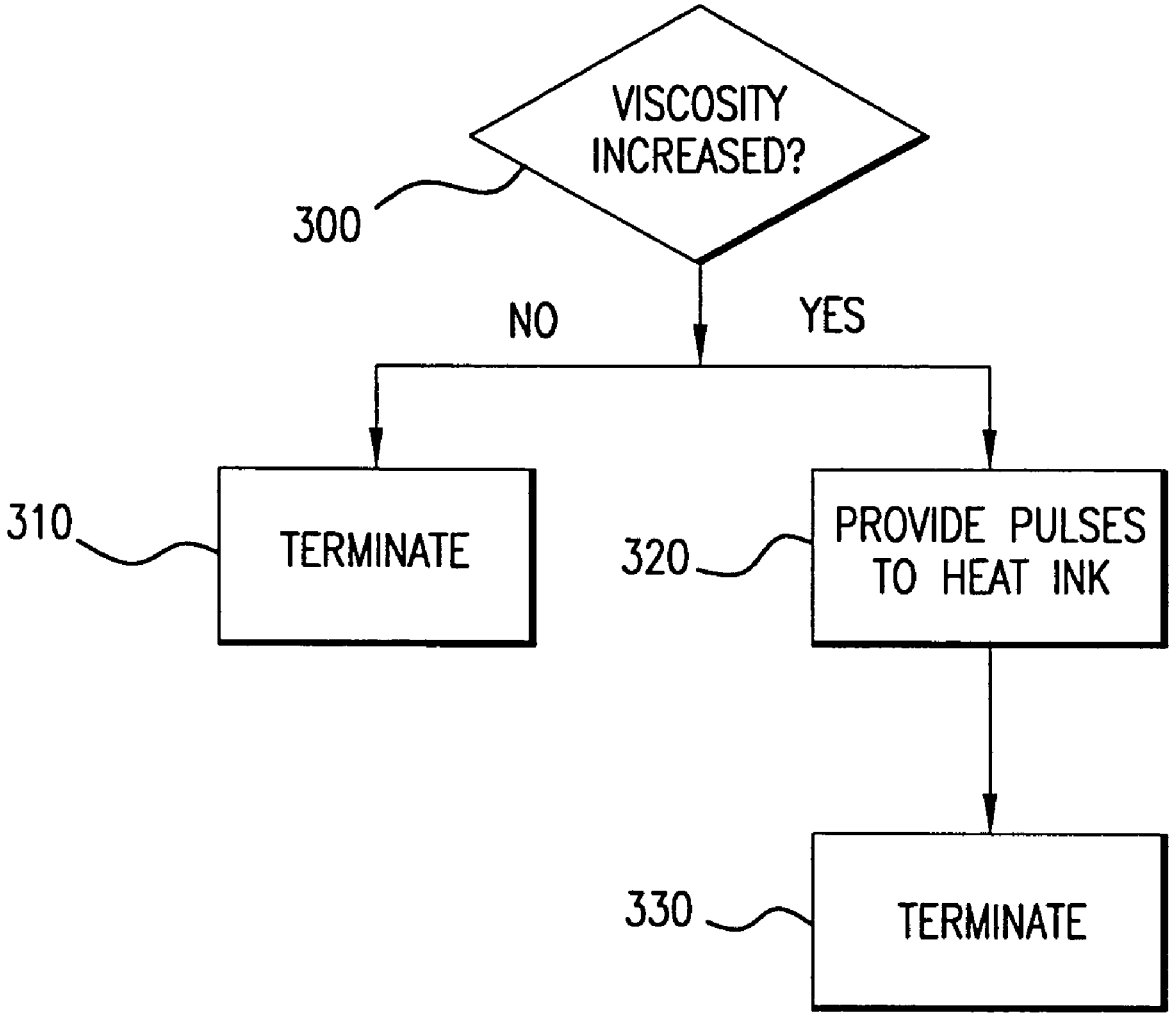
FIG. 3 illustrates a flow diagram of a process to improve ink ejection performance according to one embodiment.
Figure 4:
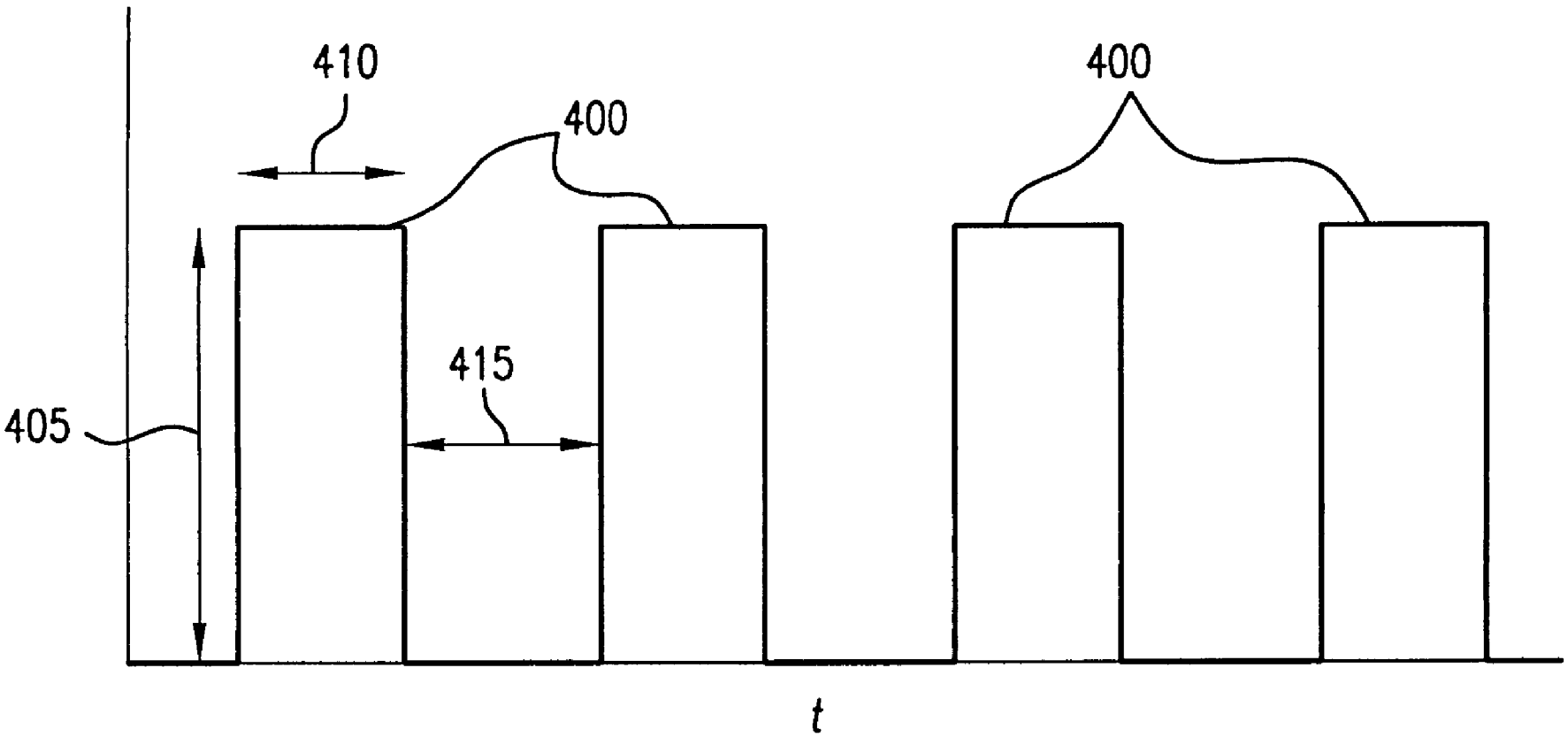
FIG. 4 illustrates a diagram of signals provided to a resistor to eject ink according to one embodiment.

In one embodiment, the reduction in viscosity of the ink in the upper portion is provided by energizing each resistor several, e.g. tens, hundreds or thousands of times when the printhead assembly 115 is not printing, as described with respect to FIGS. 3–5. The energy provided to the resistors is below the threshold where drops are ejected. No spitting occurs during this recovery step. The restoration of performance is provided for one or more of the following reasons: (i) circulation of ink by the by the below threshold energizing and replacement with fresh ink with higher water content in the upper portion 340, (ii) breaking up of viscous plugs that are formed, and (iii) decreasing the viscosity of the ink in the upper portion by a localized temperature elevation. No drops are ejected when energizing each resistor several times to heat the ink. This approach takes advantage of what occurs in a spitting operation just prior to actual drop ejection without the disadvantage of actually ejection ink droplets.

Although FIGS. 2A and 2B, depict a specific structure of fluid ejection elements, the present methods and systems may be utilized with essentially any fluid ejection element structure and materials that eject fluids, such as ink, by heating the ink in order to cause nucleation to eject the ink.

Referring to FIG. 3, a flow diagram of a process to improve ink ejection performance according to one embodiment is illustrated. In FIG. 3, a determination is made if the ink in a chamber may have a problem with plug formation or, changes in the viscosity of the upper portion, step 300. This determination may be made by determining if a printing operation, e.g. a print swath, has been completed, if a print operation is to be commenced, the printing apparatus 110 has been turned on, or a if time period has elapsed after a prior printing operation. In addition, the determination can be made so that a number of print swaths, e.g. more than two, are to be performed consecutively prior to energizing each resistor several times.

If this is not required, then the process ceases, step 310. If this is required, then pulses are provided to heat the ink, step 320. The pulse can be provided at a frequency to improve the effects. The process then ceases, step 330.

The pulse applied at a frequency, step 320, creates convection currents within the chambers which are not sufficient to cause nucleation. The convection currents created by the heat generated by the resistor 210 as a result of the pulses. The heat generated is believed to cause temperature gradients to form within the ink that is filled into the chamber 225, which help heat the ink and drive convection currents that circulated the ink to restore the water ratio to proper levels in upper portion 240 of chamber 225.

The localized temperature elevation of the ink in the firing chamber allows for thinning of thickened ink that may be formed within the upper portion 240 and removal of dye adhered to the nozzle walls 282. This in turn prevents obstructions and thereby improves the first drop-out performance of the first drops of the next print swath. By performing this operation this operation at regular intervals or prior to a print operation, the quality of a first drop out of a print operation or swath to be printed is greatly increased.

An additional advantage of such an approach as discussed with respect to FIG. 4, is that the die temperature need not be maintained at as precise limits as is known in the art. This is because there is less need to be concerned with ink thickening as a component of poor first drop out performance. The advantage provided is that the overall printhead temperature can be maintained at a modest value to retain the printhead life.

The frequency that the pulse is provided is, in one embodiment, greater than 1 kilohertz. In other embodiments, the frequency is in a range between 1 and 40 kilohertz. Further, in certain embodiments the frequency range may be between 5 and 36 kilohertz. Firing at higher frequencies allows a greater heat input and better recovery without drop ejection.

Referring to FIG. 4, a timing diagram of signals provided to a resistor according to one embodiment is illustrated. FIG. 4 depicts only a portion of the pulses 400 that are provided in order to increase heat as discussed with respect to FIG. 3. The number of pulses 400 provided is dependent upon the type of printhead assembly 115, including, for example, the balance of overtravel of the printheads over the margins where the resistor energizing may be performed and pages-per-minute print speed desired. In some embodiments, where a ¼ to 1 inch printhead travels at 30 inches per second the low energy pulsing will be sufficient to help prevent the printhead nozzles from forming viscous plugs. This is distinct from printhead warming techniques because the total duration of the below threshold energizing is too short to significantly elevated the temperature of the whole printhead. What temperature elevations that do occur are localized to the firing chamber regions to which the pulses are being provided.

Pulses 400 each have a period 405 and amplitude 410, which provide energy to heat the ink in the chamber 225 but not sufficient to cause nucleation and ink ejection from chamber 225. In addition, the cumulative effect of pulses 400 is not sufficient to cause nucleation and ink ejection from chamber 225. To do this, one or both of period 405 and amplitude 410 is selected to be below a pulse provided to a resistor 210 that causes nucleation and subsequent ink ejection. In one embodiment, period 405 is selected to be approximately seventy percent of the period of a pulse required to cause ink ejection from chamber 225. In this embodiment, amplitude 410 of pulses 400 is the same as the pulse used to eject ink. Duration 415 between pulses is constant.

The pulse energy can equivalently be reduced by decreasing the amplitude rather than the period of each pulse. In the preferred embodiment, the total pulse energy of each of the pulses 400 is below 70% of the energy required to energy a resistor to eject ink.

In one embodiment, below the threshold pulse energy required for drop ejection, pulsing at half the energy (of each pulse) but at twice the frequency gives and equivalent benefit for nozzle recovery. Therefore, to allow more power input and better recovery without drop ejection, pulsing at a maximum frequency is preferred over changing the amplitude of the pulses 400. If the energy of one of the pulses 400 is within 10 to 20% below the threshold pulse energy for drop ejection the recovery performance can be impaired. If the energy of one of the pulses 400 is at the threshold pulse energy, vapor bubbles insufficient for drop ejection may pump ink out of the nozzles, flooding the top plate. The flooded ink ray interfere with later drop ejection. Therefore it may be desirable to maintain the energy of the pulses 400 to seventy percent below the energy required to cause drop ejection.

Figure 5A:
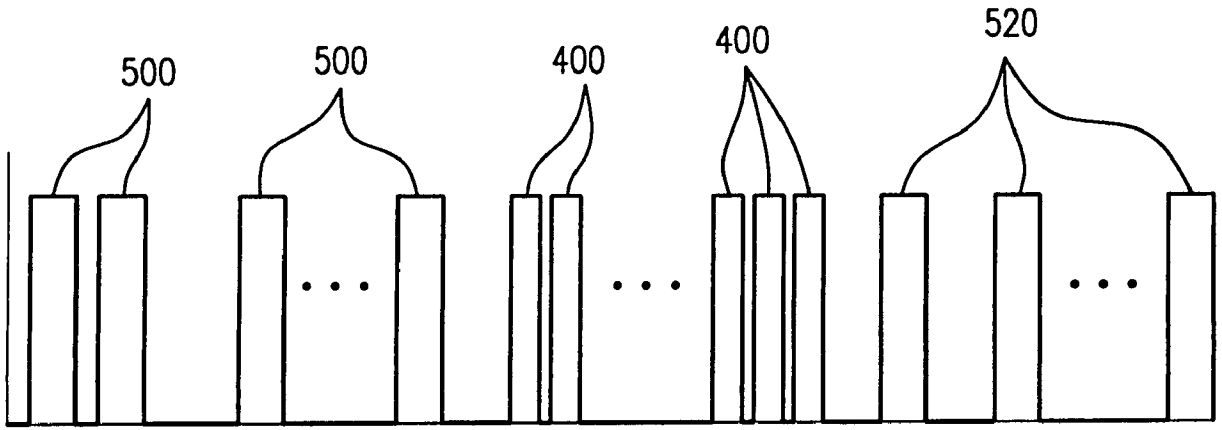
FIGS. 5A and 5B illustrate a timing diagram of signals in printing utilizing a resistor according to one embodiment.

Referring to FIG. 5A, a timing diagram of signals in printing utilizing a resistor 210 according to one embodiment is illustrated. First driving pulses 500 are provided to a resistor 210. The driving pulses are timed to properly eject ink from a chamber 225 for each of ink ejection elements that make up printhead assembly 115. The first driving pulses 500 are utilized to print a first print swath. After first driving pulses 500 are provided, pulses 400 are provided. After pulses 400 are provided, second driving pulses 520 are provided to print a second print swath.

As can be seen from FIG. 5A, first driving pulses 500 and second driving pulse 510 can be provided at different times in the first and second print swaths, since the positioning of drops from a chamber 225 will vary from one print swath to another.

With respect to a third print swath, to be printed after the second print swath, pulses 400 may or may not provided. In one embodiment, pulses 400 are provided after each print swath. In other embodiments, pulses 400 may be provided after two or more print swaths.

Figure 5B:
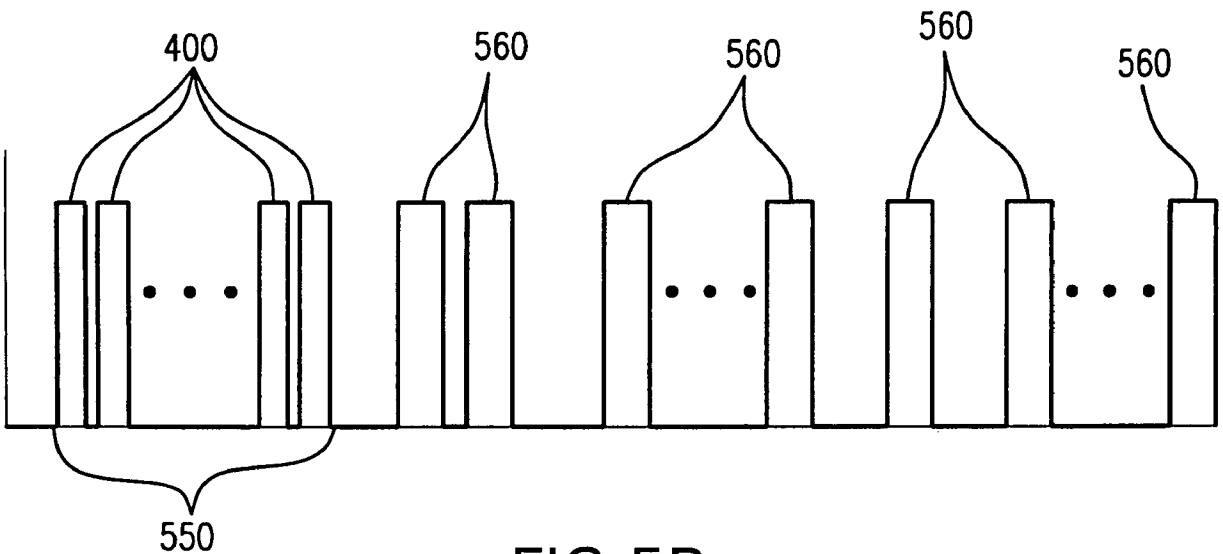

Referring to FIG. 5B, a timing diagram of signals in printing utilizing a resistor according to one embodiment is illustrated. Pulses 400 are provided during time period 550, which may be a power up of printer assembly 115 or a time elapsed after a last print operation. After pulses 400 are provided, drive pulses 560 are provided to print one or more print swaths.

As can be seen from FIGS. 5A and 5B, pulses 400 can be provided before or after a swath is printed. As can be seen from FIGS. 5A and 5B, pulses 400 are not provided before each set of drive pulse, nor are they used to preheat the die or ink in the chamber to facilitate immediate ejection, as is known in the art.

Figure 6:
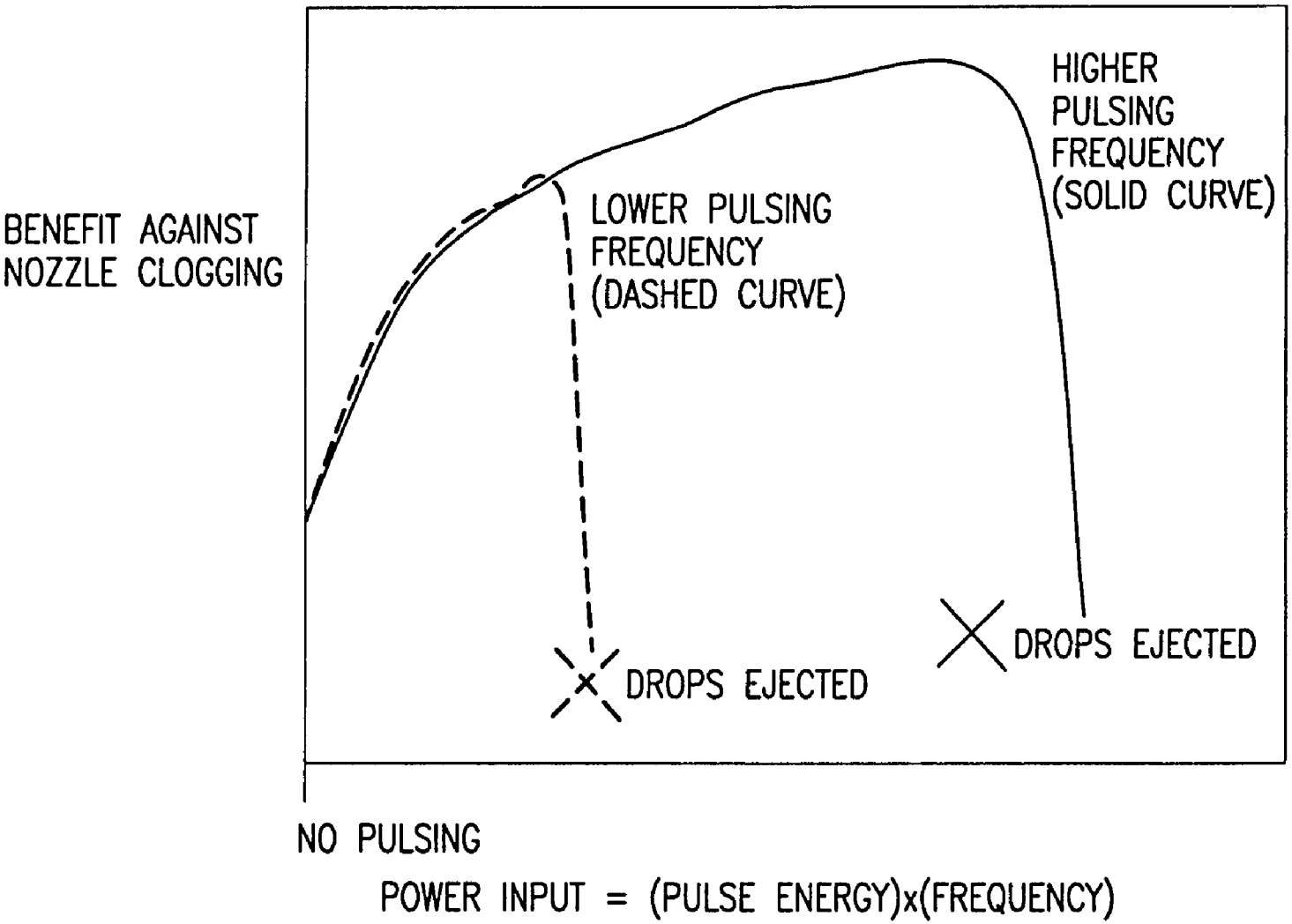
FIG. 6 illustrates a simulated graph that shows improved ink injection according to one embodiment.

Referring to FIG. 6, a simulated graph that shows improved ink injection according to one embodiment is illustrated. Pulses 400 provide an energy that can be measured as the pulse energy, period multiplied by the amplitude, multiplied by the frequency of the pulses 400. In FIG. 6, it can be seen that both high frequency and low frequency pulses improve drop ejection. It should be noted that in FIG. 6, that the low frequency curve has an average pulse energy that is approximately twice the average pulse energy of the high frequency curve.

Further, since low frequency pulsing with a higher average energy per pulse causes drop ejection at an earlier time, it is preferred, though not required, that higher frequencies with lower energies are used. In this way, spitting is less likely to occur and therefore providing pulses 400 to heat the ink can be performed at the edges of the media with a lower likelihood of ink spitting.

Figure 7:
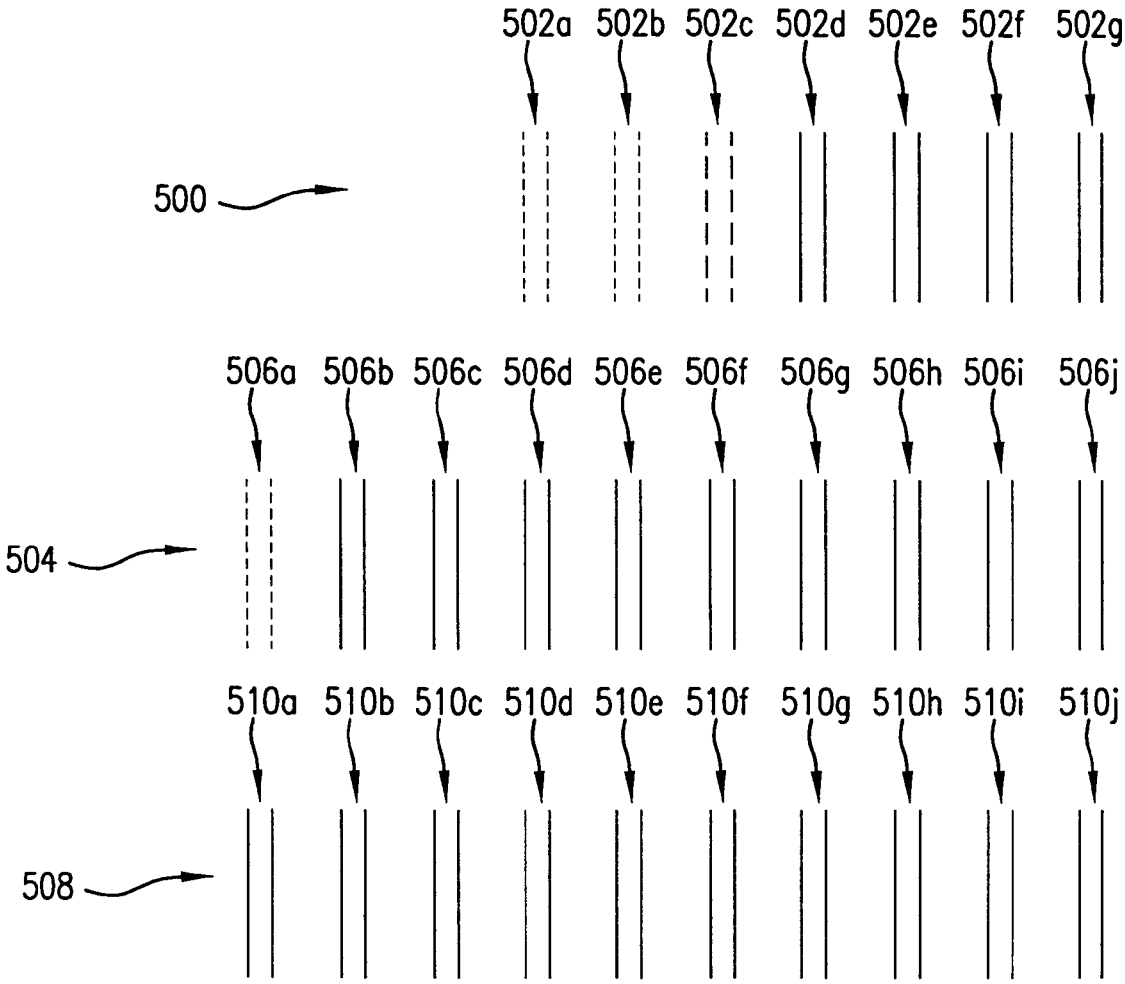
FIG. 7 illustrates the effects of ink evaporation on printing according to one embodiment.

Referring to FIG. 7, effects of ink evaporation on printing according to one embodiment are illustrated. In the embodiment of FIG. 7 a first print swath 500 is printed, after scanning the printhead back-and-forth for on the order of 20 seconds, by successive drop ejections from each nozzle. Each line pair 502*a* to 502*g* includes two lines, where the spacing within each line pair 502*a* to 502*g* is due to the spacing of the odd and even numbered nozzles on the printhead. First print swath 500 does not utilize warming or any other process to improve first drop out ejection from any nozzle. As can be seen when comparing first print swath 500 to idealized print swath 508, there are three ink ejection operations that do not generate any ink. The three ink ejection operations correspond to line pairs 510*a*, 510*b*, and 510*c* in idealized print swath 508. Further, the first line pairs, line pairs 502*a* and 502*b*, that is ejected does not eject continuous lines, but in fact ejects lines that are discontinuous, which illustrates that there either, or both, formation of viscous plugs or increased viscosity of the ink in some of the nozzles of printhead 135. In addition, a third line pair, line pair 502*c*, does not generate a continuous line as there are still partial viscous plugs formed in some of the nozzles.

Second print swath 504 is printed, after scanning the printhead back-and-forth for on the order of 20 seconds, by successive drop ejections from each nozzle. However, prior to printing second print swath the resistors that generate heat to eject ink are energized according to the methods described in FIGS. 3–5. As can be seen, second print swath 504 includes a same number of line pairs 506*a* to 506*j* as idealized print swath 508, 510*a* to 510*j*. Further, line pairs 506*b* to 506*j* are continuous solid lines just as are idealized line pairs 510*b* to 510*j*. It should be noted that line pair 506*a*, which is the first line pair to be printed as printhead 135 scans from left to right, still may contain lines that are discontinuous, which means not all of the nozzles are cleared. However, a great benefit is still provided by pulses 400 as can be scene by comparing first print swath 500 and second print swath 506.

Figure 8:
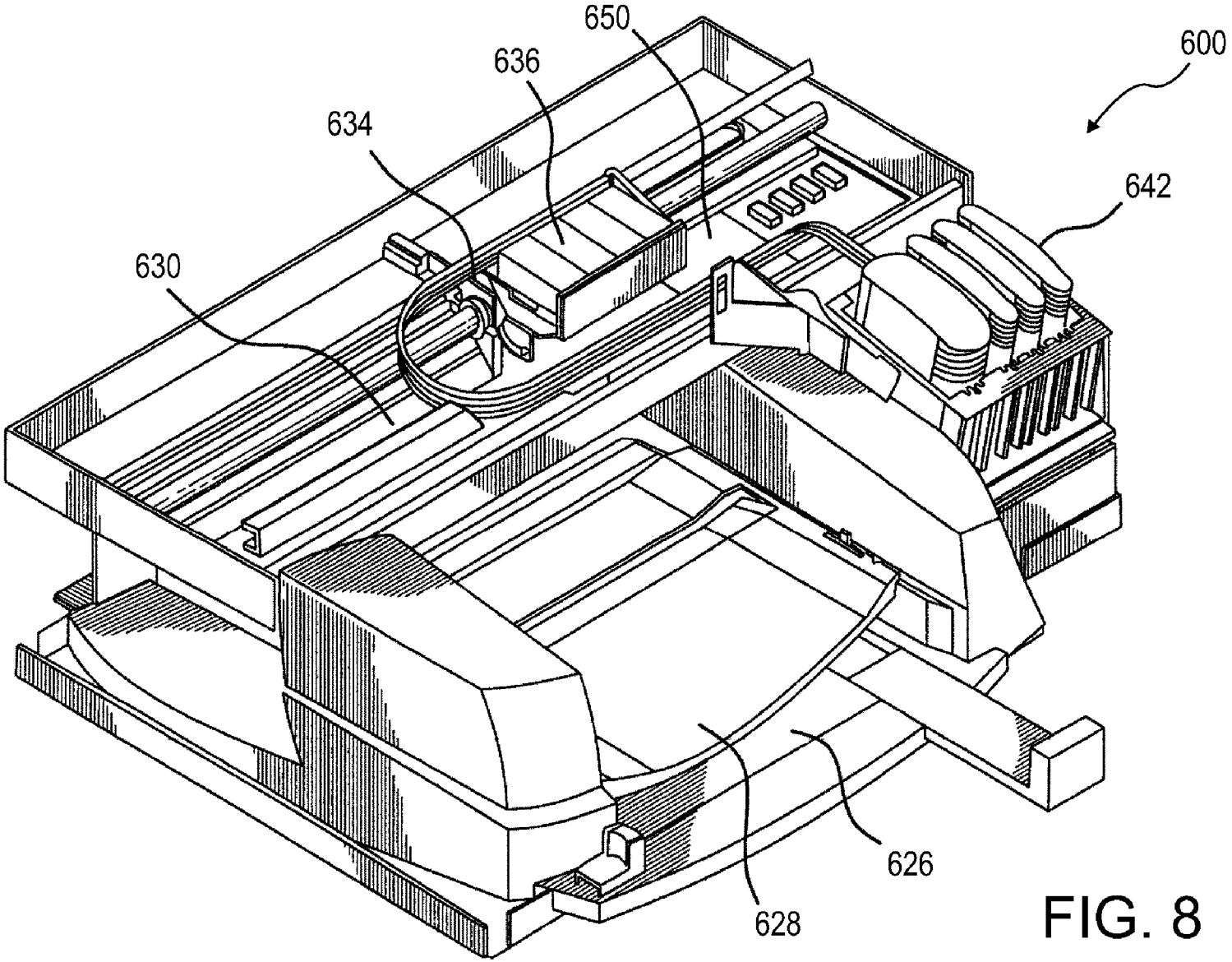
FIG. 8 illustrates a printer according to one embodiment.

Referring to FIG. 8, printer 600 according to one embodiment is illustrated. Generally, printer 600 can incorporate the printing system 100 of FIG. 1 and further include a tray 622 for holding print media. When a printing operation is initiated, print media, such as paper, is fed into printer 600 from tray preferably using a sheet feeder 626. The media then brought around in a U direction and travels in an opposite direction toward output tray 628. Other paper paths, such as a straight paper path, can also be used. The media is stopped in a print zone 630, and a scanning carriage 634, supporting one or more printhead assemblies 636 (an example of printhead assembly 116 of FIG. 1), is then scanned across the sheet for printing a swath of ink thereon. After a single scan or multiple scans, the sheet is then incrementally shifted using, for example, a stepper motor and feed rollers to a next position within the print zone 630. Carriage 634 again scans across the sheet for printing a next swath of ink. The process repeats until the entire sheet has been printed, at which point it is ejected into output tray 628.

Also shown in FIG. 8 is a spittoon. 650 into which print cartridges 636 eject non-printing ink drops, i.e., "spit" during printing operations and during routine servicing of the print cartridges 636. As shown in FIG. 8, spittoon 650 is located on the right side just out of the print zone of printer 600. During printing operation if spitting is required the carriage 634 moves the print cartridges 636 beyond the print zone so the print cartridges 636 can spit over the spittoon 650. While in FIG. 8 spittoon 650 is depicted, such a spittoon is not needed, as discussed with respect to FIGS. 2A–5B.

In one embodiment, with or without spittoon 250 present, pulses are provided when printhead assemblies 636 are positioned at or past an edge 660 of media 625.

The print assemblies 636 can be removably mounted or permanently mounted to the scanning carriage 634. Also, the printhead assemblies 636 can have self-contained ink reservoirs (for example, the reservoir can be located within printhead body 304 of FIG. 1). Alternatively, each print cartridge 636 can be fluidically coupled, via a flexible conduit 640, to one of a plurality of fixed or removable ink containers 642 acting as the ink supply 112 of FIG. 1. As a further alternative, the ink supplies 612 can be one or more ink containers separate or separable from printhead assemblies 636 and removably mountable to carriage 634.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method for printing an image comprising:

performing a first print operation utilizing a printhead comprising a plurality of resistors by ejecting ink from a plurality of chambers each associated with at least one of at least some of the plurality of resistors;

selectively energizing at least some of the plurality of resistors at an energy level insufficient to eject ink from the plurality of chambers by providing at least one pulse at a first frequency to each of at least some of the plurality of resistors; and performing a second print operation utilizing the printhead by ejecting ink from at least some of the plurality of chambers, wherein one or more of:

the pulse has a duration that is at most 0.7 times a duration of another pulse provided to eject ink from the plurality of chambers;

the first frequency is in a range between approximately 5 kHz and approximately 36 kHz; and, the first frequency is greater than approximately 1 kHz.

2. The method of claim 1 further comprising performing a third print operation utilizing at least some of the plurality of resistors and then selectively energizing one or more of the plurality of resistors at the energy level insufficient to eject ink.

3. The method of claim 2 wherein the first, second, and third operations comprise printing a different print swath.

4. The method of claim 1 wherein selectively energizing at least some of the plurality of resistors at the energy level insufficient to eject ink comprises energizing all of the plurality of resistors at the energy level.

5. The method of claim 1 wherein to eject ink from the chambers each of the at least some of the plurality of resistors that causes ink ejection is provided with energy at a first energy level and wherein the energy level insufficient to eject ink from the plurality of chambers is at most 0.7 times the first energy level.

6. A method of ejecting ink from a fluid ejection device including a plurality of resistors, each of the resistors including a resistor that heats ink to eject ink from the resistors, comprising:

ejecting ink using at least some of the resistors, wherein in order to eject ink each of the at least some resistors are energized at approximately a first energy level;

selectively energizing the at least some of the resistors at approximately a second energy level which is less than the first energy level and is at most 0.7 times the first energy level; and ejecting ink using one or more of the resistors, wherein in order to eject ink each of the one or more resistors are energized at approximately the first energy level.

7. The method of claim 6 wherein ejecting ink from one or more resistors occurs after selectively energizing the at least some of the resistors at approximately the second energy level.

8. The method of claim 6 wherein selectively energizing at least some of the plurality of resistors comprises providing a plurality of pulses at a first frequency.

9. The method of claim 8 wherein the first frequency is greater than approximately 1 kHz.

10. The method of claim 8 wherein the first frequency is in a range of between approximately 5 kHz and approximately 36 kHz.

11. The method of claim 8 wherein the pulse has a duration and another pulse to eject ink from one of the at least some resistors, the another pulse has another duration, and wherein the duration is less than the another duration.

12. The method of claim 11 wherein the duration is at most 0.7 times the another duration.

13. The method of claim 6 further comprising ejecting ink from one or more of the resistors and then selectively energizing the at least some of the resistors at approximately the second energy level.

14. The method of claim 6 further comprising ejecting ink from at least one of the at least some of the plurality of resistors while selectively energizing the at least some of the plurality of resistors at the energy level insufficient to eject ink.

15. A fluid printer comprising:

a printhead including a plurality of resistors that when energized at a first energy level cause ink to be ejected from a corresponding chamber; and a controller coupled with the plurality of resistors, the controller selectively energizing at least some of the plurality of resistors at an energy level that is less than the first energy level, wherein one or more of:

the controller provides at least one pulse to each of the at least some of the plurality of resistors to selectively energize the at least some of the plurality of resistors at a first frequency in a range between approximately 5 kHz and approximately 36 kHz;

the controller provides at least one pulse to each of the at least some of the plurality of resistors to selectively energize the at least some of the plurality of resistors at the first frequency greater than approximately 1 kHz;

the controller provides at least one pulse to each of the at least some of the plurality of resistors to selectively energize the at least some of the plurality of resistors, the pulse having a duration that is at most 0.7 times a duration of another pulse provided to eject ink; and, the energy level is at most 0.7 times the first energy level.

16. A fluid ejection assembly comprising:

a fluid ejection device including a plurality of resistors that when energized at a first energy level cause ink to be ejected from a related chamber; and means for selectively energizing at least some of the plurality of resistors at an energy level that is less than the first energy level, wherein one or more of:

the means provides at least one pulse to each of the at least some of the plurality of resistors to selectively energize the at least some of the plurality of resistors at a first frequency in a range between approximately 5 kHz and approximately 36 kHz;

the means provides at least one pulse to each of the at least some of the plurality of resistors to selectively energize the at least some of the plurality of resistors at the first frequency greater than approximately 1 kHz;

the means provides at least one pulse to each of the at least some of the plurality of resistors to selectively energize the at least some of the plurality of resistors, the pulse having a duration that is at most 0.7 times a duration of another pulse provided to eject ink; and, the energy level is at most 0.7 times the first energy level.

* * * * *

UNITED STATES PATENT AND TRADEMARK OFFICE

CERTIFICATE OF CORRECTION

PATENT NO. : 7,204,585 B2
APPLICATION NO. : 10/833402
DATED : April 17, 2007
INVENTOR(S) : Paul J. Bruinsma et al.

It is certified that error appears in the above-identified patent and that said Letters Patent is hereby corrected as shown below:

In column 3, line 44, delete “droning” and insert -- drolling --, therefor.

In column 6, line 51, delete “ray” and insert -- may --, therefor.

In column 8, line 15, after “from” insert -- a --.

Signed and Sealed this

Second Day of September, 2008

JON W. DUDAS
*Director of the United States Patent and Trademark Office*